United States Patent [19]

Yamada et al.

[11] Patent Number: 5,071,269

[45] Date of Patent: Dec. 10, 1991

[54] WIRING OF ACTUATORS IN A WIRE-DOT PRINT HEAD

[75] Inventors: Tetsuhiro Yamada; Tatsuya Koyama; Eisaku Mutoh, all of Tokyo, Japan

[73] Assignee: Oki Electric Industry Co., Ltd., Tokyo, Japan

[21] Appl. No.: 330,403

[22] Filed: Mar. 29, 1989

[30] Foreign Application Priority Data

Apr. 4, 1988 [JP] Japan ..... 63-81241

[51] Int. Cl.[5] ..... B41J 2/30

[52] U.S. Cl. ..... 400/124; 101/93.05

[58] Field of Search ..... 400/124, 157.2; 101/93.05, 93.29

[56] References Cited

U.S. PATENT DOCUMENTS 4,286,517 9/1981 Katagiri et al. ..... 101/93.14
4,473,311 9/1984 Sakaida ..... 400/124

FOREIGN PATENT DOCUMENTS 224762 12/1983 Japan ..... 400/124
225768 11/1985 Japan ..... 400/124
113567 5/1987 Japan .

*Primary Examiner*—David A. Wiecking
*Attorney, Agent, or Firm*—Panitch Schwarze Jacobs & Nadel

[57] ABSTRACT

In a wire-dot print head which comprises print elements arranged in a ring, each having an electromagnet formed of a core and a coil, and in which the electromagnets are divided into a plurality of blocks so that each block has a plurality of electromagnets, and a common current conduction control element is provided for each block and used to control current through the coils of the electromagnets in the block, the electromagnets of each of at least some of the blocks are disposed so as not to be physically adjacent to each other. Because of the above arrangement, currents through the coils due to magnetic interference between the adjacent electromagnets is reduced and power consumption is reduced.

12 Claims, 5 Drawing Sheets

WIRING OF ACTUATORS IN A WIRE-DOT PRINT HEAD

BACKGROUND OF THE INVENTION

The present invention relates to a wire-dot print head of the spring-charge type used in a serial printer, and more particularly to a spring-charge type wire-dot print head having a configuration in which two or more electromagnets provided for respective print wires are energized through a common current conduction control element.

Various types of wire-dot print heads for use in a serial printer are known. One of them is a wire-dot print head of the spring-charge type in which a plate spring is resiliently deformed by attraction of an armature fixed to the plate spring due to a magnetic flux from a permanent magnet, and then released by energization of an electromagnet producing a magnetic flux cancelling the magnetic flux from the permanent magnet, so that the armature and a print wire fixed to the armature project to strike a printing paper through an ink ribbon. This causes transfer of ink from the ink ribbon onto the printing paper, effecting printing of one dot. In such a wire-dot print head, it is common that print elements, each comprising a print wire, an armature, a plate spring, an electromagnet, and a permanent magnet, are arranged in a ring. A problem associated with a prior-art wire-dot print head of this type is a magnetic interference and current induction between adjacent print elements, with attendant current induction and hence waste of power. This will be described in further detail with reference to the drawings.

FIG. 5 is a side view, half in section, showing the mechanical structure of a general spring-charge type wire-dot print head.

As illustrated, stacked on the peripheral surface of a disk-shaped rear yoke or base yoke 7 are an annular permanent magnet 4, an annular intermediate yoke 5, and an annular front yoke 6 having a first annular part 6*b*. A plate spring unit 3 comprises an annular support part 3*b* and radial parts 3*a* extending from the annular part 3*b* radially inward, i.e., toward the central axis CA of the disk-shaped rear yoke 7. Each of the radial parts 3*a* is also called a "plate spring". Fixed to the free end of each plate spring radial part 3*a* is an armature 2. The annular part 3*b* of the plate spring 3 is rigidly clamped between the annular part 6*b* of the front yoke 6 and the intermediate yoke 5. The front yoke 6 also has a second annular part 6*c* continuous with the first annular part 6*b* and extending from the first annular part 6*b* to be positioned in front of the armatures 2, and radial parts 6*a* extending from the second annular part 6*c* rearwardly (downwardly as seen in FIG. 5) to be positioned between adjacent armatures 2.

The armature 2 has a free end to which a rear end (base part) of a print wire 1 is rigidly attached. The tip (front end) of print wire 1 is arranged so that it can project through a guide aperture 11*a* of a wire guide 11 forming in the front end of the center of a front cover 15. The print wires 1 of the respective print elements are collected in the guide apertures 11*a* so that they are in a predetermined arrangement. The front cover 15 has an annular part 15*b* stacked on and fixed to the annular part 6*b* of the front yoke 6.

Located in the central portion of the rear yoke 7 are cores 8 on which coils 9 are wound, to form electromagnets. The cores 8 confront the rear surfaces of the armatures 1.

Although there are a plurality of the wires 1, the armatures 2 respectively supporting the wires 1, the plate spring radial parts 3*a* respectively supporting the armatures 2, and the cores 8 respectively associated with the armatures 2, FIG. 5 depicts only one of each for simplicity of illustration.

The print wires 1, the armatures 2, the plate springs 3, the permanent magnet 4, the intermediate yoke 5, the front yoke 6, the rear yoke 7, the cores 8 and the coils 9 form print elements. In the print head, the permanent magnet 4, the intermediate yoke 5, the front yoke 6, and the rear yoke 7 are common constituent parts, while the movable parts consisting of the print wires 1, the armatures 2 and the plate springs 3, and the electromagnets consisting of the cores 8 and the coils 9 are arranged in a ring on the rear yoke 7, to form a plurality of print elements.

FIG. 6 is a section along line A—A of FIG. 5. In the figure, reference marks 2*a* to 2*c* denote armatures, reference marks 8*a* to 8*c* are cores, and reference marks 9*a* to 9*c* denote coils. The armatures 9*a* and the core 8*a*; the armature 9*b* and the core 8*b*; and the armature 9*c* and the core 8*c* respectively form electromagnets.

FIG. 6 shows three electromagnets physically adjacent to each other in FIG. 5 and the corresponding armatures 2.

The printing operation of each printing element in the print head is as follows:

First, when the coil 9 in the above-described structure is not energized, the magnetic flux from the permanent magnet 4 passes through a magnetic path consisting of the intermediate yoke 5, the front yoke 6, the armature 2, the core 8 and the rear yoke 7, along a loop indicated by arrow P1. The armature 2 is attracted to the core 8 because the distance between the armature 2 and the core 8 is shorter than the distance between the armature 2 and the rearwardly (downwardly, as seen in FIG. 5 and FIG. 6) facing surface of the second annular part 6*c* of the front yoke 6, and because most of the magnetic flux between the armature 2 and the front yoke 6 passes through the gap between the armature 2 and the laterally facing surfaces of the radial parts 6*a* of the front yoke 6, rather than the rearwardly (downwardly, as seen in FIG. 5 and FIG. 6) facing surface of the second annular part 6*c* of the front yoke 6. As a result, the plate spring 3 is resiliently deformed or bent, and a strain energy is stored in the plate spring 3.

If, in this state, the coil 9 is energized, the magnetic flux developed in the core 8 by the coil 9 will cancel the magnetic flux developed by the permanent magnet 4. Therefore, the armature 2 will be released from the core 8. As a result, the plate spring 3*a* will restore its natural state, and the armature 2 and the print wire 1 are driven forward, and the tip of the print wire 1 will be ejected in the forward (upward as seen in the figure) direction through the guide aperture 11*a* in the front cover 15 and will print a dot forming part of a character or other print output onto a printing paper PP through an ink ribbon IR placed between the tip of the wire 1 and the printing paper PP on a platen PL.

The above describes the operation of one print element. By using a control circuit, not shown, to selectively energize the coils 9 of the respective print elements responsive to the print data, characters, numerals, etc. of dot configuration can be printed on the printing paper PP.

In this type of wire-dot print head in the prior art, two or more physically adjacent electromagnets are made to form a block, all the electromagnets are thereby divided into a plurality of blocks, and a common current conduction control element is provided for each block to control the energization of the coils of the electromagnets.

FIG. 7 is a diagram of a drive circuit for the coils 9 in the prior-art wire-dot print head. Three electromagnets, shown in FIG. 6, are made to form a block for control of energization.

As illustrated, first ends of the coils 9*a* to 9*c* are connected to the collector of a PNP transistor T-d for controlling the energization of the coils 9*a* to 9*c*. The emitter of the transistor T-d is connected to a first, or positive terminal of a power supply E supplying electric energy to the coils 9*a* to 9*c*. Second ends of the coils 9*a* to 9*c* are connected to collectors of NPN transistors T-a, T-b and T-c which control the energization of the coils 9*a* to 9*c* individually and the anodes of diodes D-a, D-b and D-c.

The cathodes of the diodes D-a, D-b and D-c are connected to the first terminal of the power supply E. The emitters of the transistors T-a, T-b and T-c are connected to the first ends of the coils 9*a* to 9*c* through a diode D-d for conducting a circulating current. The emitters of the transistors T-a, T-b and T-c are also connected to the ground G. The second, or negative terminal of the power supply is also grounded.

Although not illustrated, the circuit configuration in other blocks is similar.

The operation of the above-described configuration will now be described.

As an example, it is assumed that the coil 9*a* is energized so that the armature 2*a* associated with the coil 9*a* and the print wire 1 are projected to effect printing.

The printing of one dot, in one printing cycle can be divided into three stages. The first stage lasts from the commencement of excitation of the selected electromagnet and until about the commencement of forward movement of the associated armature and the print wire. The second stage lasts from about the commencement of the forward movement of the armature and the print wire and until about the impact of the print wire on the printing paper. The third stage lasts from about the impact of the print wire on the printing paper and until the current due to an electromotive force induced in the coil ceases. The commencement of the forward movement of the armature and the print wire, and the impact of the print wire on the printing paper can be detected by means not shown, or assumed to occur at predetermined timings, by use of timing elements.

FIG. 8 is a diagram showing the waveforms of the currents flowing through the coil 9*a* in the first, second and third stages. The parts [1], [2] and [3] correspond to the first, second and third stages, respectively.

In the first stage, a signal DT1 applied to the transistor T-d is Low (Active), so the transistor T-d is ON, and also a signal DT-2 applied to the transistor T-a is High so the transistor T-a is ON. The other transistors T-b and T-c are kept OFF. The current flows, as shown by arrow [1], i.e., from the first terminal of the power supply E, then through the transistor T-d, then the coil 9*a*, and then the transistor T-a, and then to the ground. Because of this current, the electromagnet is excited to generate a magnetic flux and the associated armature and the print wire begin to move.

In the second stage, the signal DT1 is High (Inactive), while the signal DT2 is High, so the transistor T-a is kept ON, while the transistor T-d is OFF. Although the coil 9*a* is isolated from the power supply E, an electromotive force induced in the coil 9*a* causes a current to flow through the path shown by arrow [2], i.e., from the coil 9*a*, then through the transistor T-a, and then the diode D-d, and then back to the coil 9*a*.

In the third stage, the signal DT2 applied to the transistor T-a also Low, so the transistor T-a is also OFF. Because of the electromotive force still induced in the coil 9*a*, a current flows through the path as shown by arrow [3], from the ground, then through the diode D-a, then the coil 9*a*, and then the diode D-a, and then to the first terminal of the power supply E. This current rapidly diminishes.

A problem associated with the prior art described above is that, induced by the electromagnet having a coil being energized, a current also flows through a coil of an electromagnet which is physically adjacent to the electromagnet having the coil being energized.

This phenomenon will be described in further detail.

That is, the canceling magnetic flux that is created when the coil 9*a* of the electromagnet is energized, not only flows through the core 8*a* in a direction opposite to the attracting magnetic flux of the permanent magnet 4, but also flows through the adjacent armatures 2*b* and 2*c* and cores 8*b* and 8*c*, along loops P2 and P3, to cause a magnetic interference.

As a result, a current flows through the coils 9*b* and 9*c* of the adjacent electromagnets, and whereas only the coil 9*a* in FIG. 7 is energized induction currents also flow through the coils 9*b* and 9*c*. That is the currents due to the magnetic interference flow through the transistor T-d, then through the coils 9*b* and 9*c*, then through the diodes D-b and D-c.

Because of the induction current which flows through the coils of the adjacent electromagnet that is not energized, the power is wasted.

SUMMARY OF THE INVENTION

The present invention has been made to solve these problems, and its object is to provide a wire-dot print head with a low power consumption in which unwanted induction current through an electromagnet which is physically adjacent to the coil of the electromagnet that is energized is eliminated or reduced.

To accomplish the above object, the invention provides a wire-dot print head in which the electromagnets are divided into a plurality of blocks each having two or more electromagnets, a common current conduction control element is provided for each block and used to control the current through the coils of the electromagnets in the block, wherein the electromagnets having the coils energized by a current which is passed through said common current conduction control element of each of at least some of all the blocks are disposed so as not to be physically adjacent to each other.

When a coil of an electromagnet is energized, almost no magnetic interference occur in the electromagnet of the same block having a coil that is not energized. The phenomenon in which an induction current flows through the coils of the adjacent electromagnets can be restricted to the minimum. The electric power consumed per print element can be reduced. Waste of power is therefore reduced, and a wire-dot print head with a reduced power consumption can be provided.

DETAILED DESCRIPTION OF THE EMBODIMENTS

An embodiment of the invention will now be described with reference to the drawings.

Figure 5:
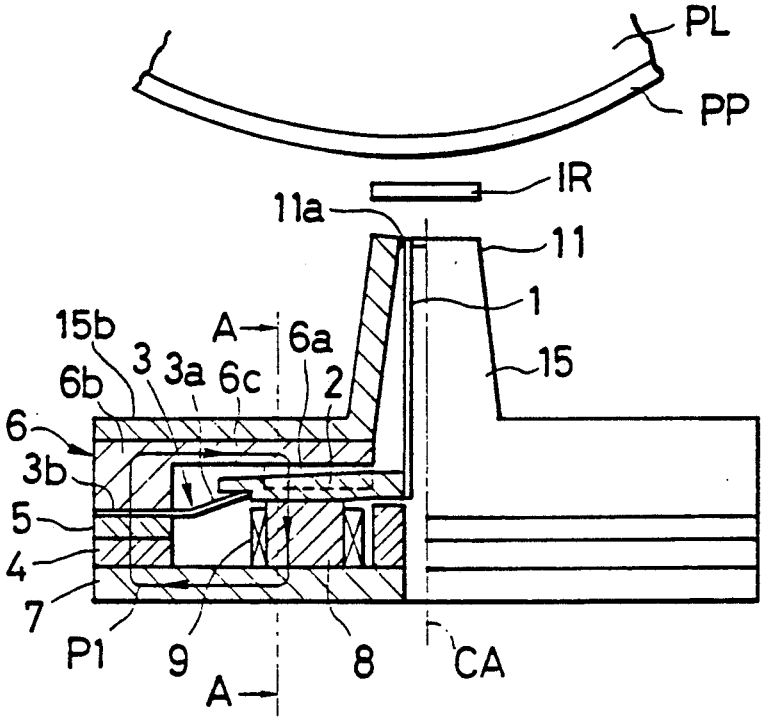
FIG. 5 is a side view, half in section, showing the mechanical structure of a general spring-charge wire-dot print head.
Figure 6:
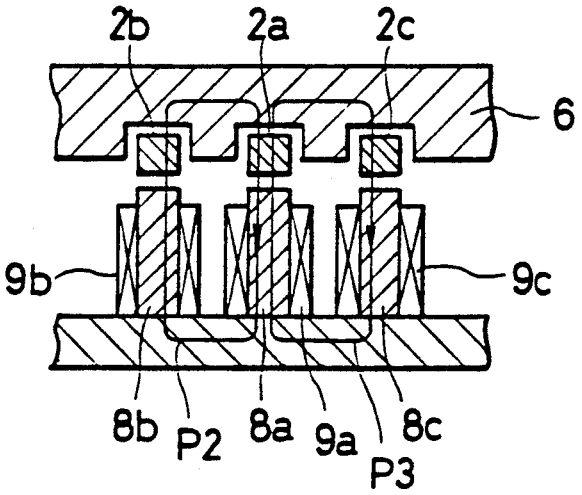
FIG. 6 is a sectional view along line 6—6 in FIG. 5.

The mechanical structure of a wire-dot print head of this embodiment is identical to that described with reference to FIG. 5 and FIG. 6.

The invention is featured by the unique wiring of the coils of the electromagnets and the current conduction control elements.

Figure 1:
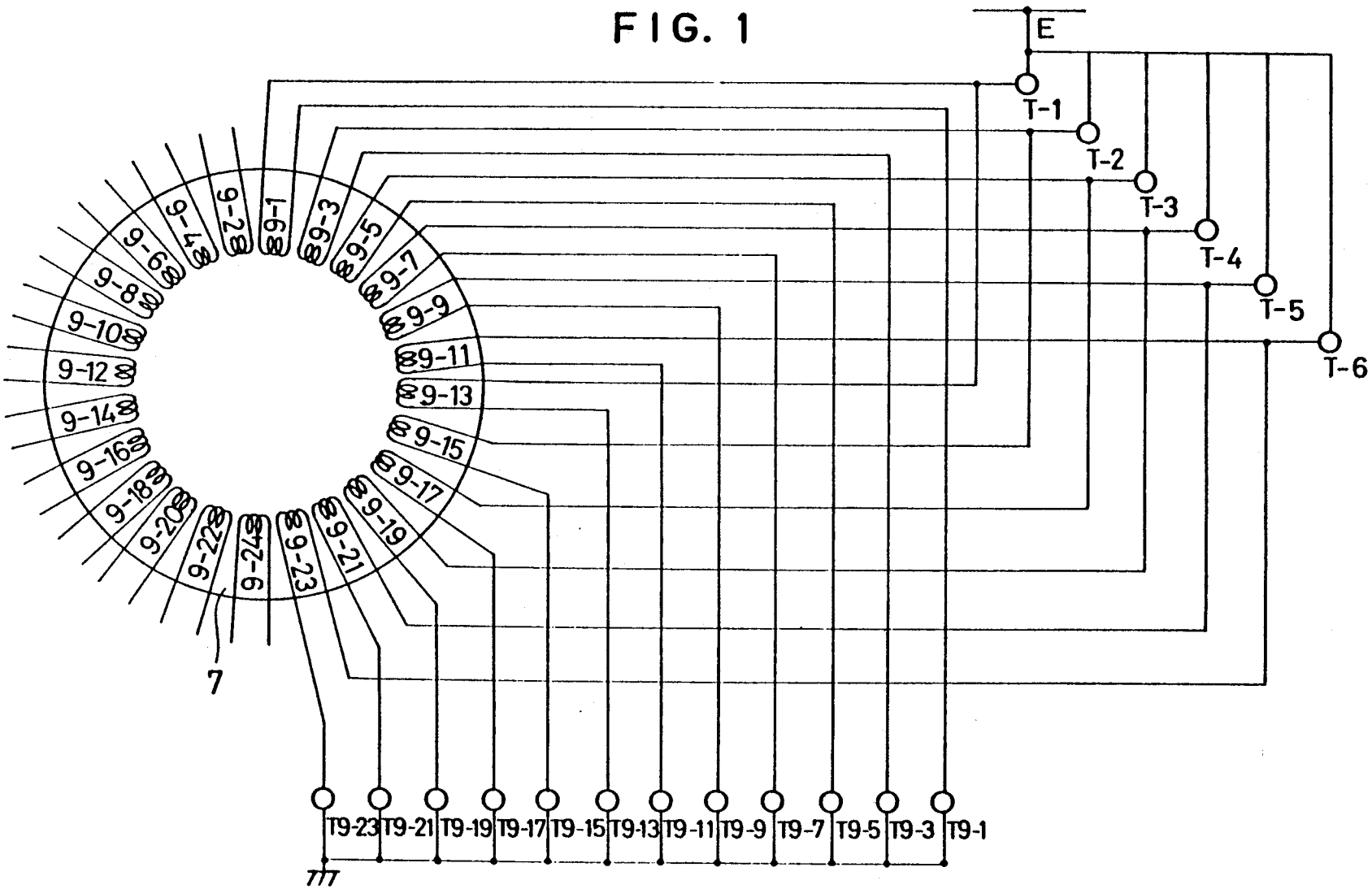
FIG. 1 is a wiring diagram showing a first embodiment of a wire-dot print head according to the present invention.

FIG. 1 is a wiring diagram showing a first embodiment of the invention. More specifically, it is a diagram showing how the coils of the electromagnets and a transistor which is the common current conduction control element are connected. In FIG. 1, the positions of the coils 9-1 to 9-24 on the circle schematically representing the rear yoke 7 represent the physical positions of the electromagnets having the coils.

The example of wire-dot print head illustrated has 24 print wires. In the figure, reference marks 9-1 to 9-24 denote coils of the electromagnets corresponding to the those *9a* to *9c* in FIG. 7, and 12 odd-numbered coils 9-1 to 9-23 and 12 even-numbered coils 9-2 to 9-24 are disposed, being divided on the right side and left side of the rear yoke 7.

The coils 9-1 to 9-24 are wound on the cores 8 (see FIG. 5), but the cores are not illustrated in FIG. 1.

Figure 7:
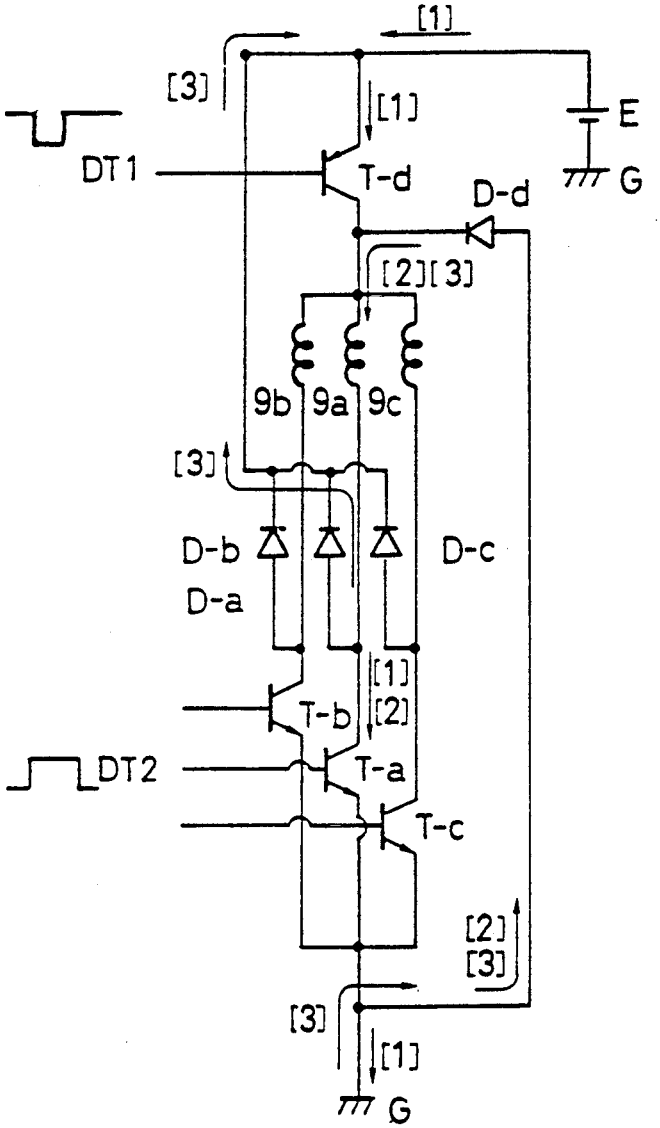
FIG. 7 PRIOR ART
FIG. 7 is a diagram showing a drive circuit for coils in a prior-art wire-dot print head.
Figure 8:
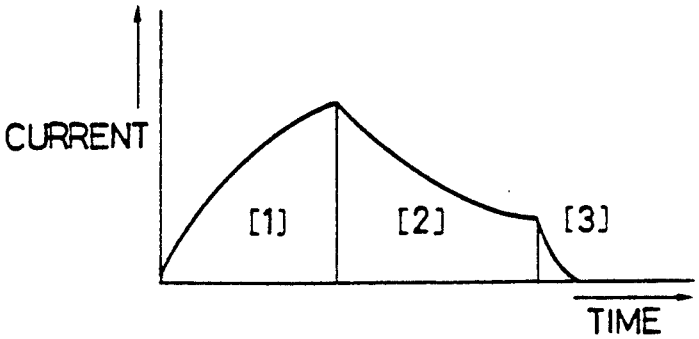
FIG. 8 PRIOR ART
FIG. 8 is a diagram showing waveforms of currents in FIG. 7.

Reference marks T-1 to T-6 denote transistors which are common current conduction control elements corresponding to that T-d in FIG. 7. Reference marks T9-1 to T9-23 are transistors which are individual current conduction control elements corresponding to those T-a to T-c in FIG. 7.

As illustrated, in this embodiment, first ends of the coils 9-1 and 9-13 are connected together and connected through the transistor T1 to a first, positive terminal of a power supply E. Similarly, first ends of the coils 9-3 and 9-15; first ends of the coils 9-5 and 9-17; first ends of the coils 9-7 and coils 9-19; first ends of the coils 9-9 and coils 9-21; and first ends of the coils 9-11 and 9-23 are connected together and through transistors T2 to T6 to the positive terminal of the power supply E. Second ends of the coils 9-1 to 9-23 are connected to the collectors of the transistors T9-1 to T9-23, respectively.

In other words, in the wire-dot print head according to the present embodiment, two electromagnets are made to form a block, and the electromagnets belonging to the same block, i.e., having coils whose energization is controlled by a common current conduction control element, e.g., coils 9-1 and 9-13, are disposed so as not to be physically adjacent to each other on the rear yoke 7.

The 12 even-numbered coils 9-2 to 9-24 are provided with transistors in a manner similar to that described with reference to the odd-numbered coils 9-1 to 9-23 such that additional transistors (not shown) are provided for the second ends of the respective coils. The first ends of the coils are attached to common transistors (not shown) in the same manner as odd numbered coils 9-1 through 9-23 are connected to transistors T-1 through T-6 so that adjacent coils (for example, 9-1 and 9-2) are not connected to the same common transistor.

Although not illustrated, for the 24 coils 9-1 to 9-24, diodes corresponding to those D-a to D-d in FIG. 7 are provided. Moreover, the print elements in the print head are comprised of the print wire 1, the armatures 2, the plate spring 3, the permanent magnet 4, the intermediate yoke 5, the front yoke 6, the rear yoke 7, the cores 8 and the coils 9, as explained with reference to FIG. 5.

The effects of the present embodiment with the above configuration are as follows: The energization of the coils 9-1 to 9-24 is effected in the same way as explained with reference to FIG. 7. But, in the present embodiment, the coils 9-3 and 9-15 of the electromagnets energized through a common current conduction control element, e.g., a transistor T2, are disposed so as not be physically adjacent to each other, as described above, so that when for example the coil 9-3 is energized and a magnetic flux passes through the cores of the adjacent electromagnets having coils 9-1 and 9-5, the current through the coils 9-1 and 9-5 of the adjacent electromagnets and the common current conduction control elements T-1 and T-3 for the adjacent electromagnets do not flow because the common current conduction control elements are OFF. Moreover, because the electromagnet whose coil 9-15 is connected to the same common current conduction control element T-2 is physically separated from the electromagnet having the coil 9-3, the magnetic flux from the electromagnet having the coil 9-3 is negligible so the current due to the magnetic interference is negligible.

When the electromotive force induced in the coils 9-1 and 9-5 due to the magnetic interference is in the direction from the second to first ends, a current can flow through the path similar to the path [3] in FIG. 7. But the magnitude of this current is very small. Furthermore, it can happen that simultaneously with the conduction of the common current conduction control element T-2, the common current conduction control element T-3, for example, or the individual current conduction control element T9-5, for example, connected to the coil 9-5 of the adjacent electromagnet is ON. In this case, a current due to the magnetic interference can flow. But the probability of this to happen is smaller than 100%, so the current due to the magnetic interference and hence the waste of power is smaller than if the arrangement of the invention is not adopted.

Experimental data on the power consumption of a wire-dot print head according to the present embodiment and a prior-art wire-dot print head when they are driven will now be described.

Figure 4:
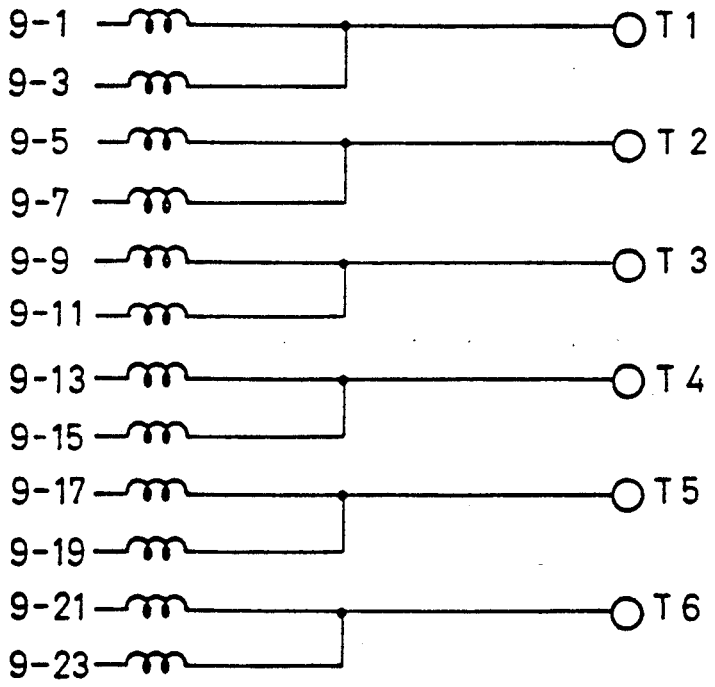
FIG. 4 PRIOR ART
FIG. 4 is a wiring diagram showing a prior-art wire-dot print head used in the experiment.

In the experiment, the wire-dot print head according to the present embodiment has the configuration shown in FIG. 1, while the prior-art wire-dot print head has the configuration shown in FIG. 4.

That is, in the configuration of FIG. 4, the coils 9-1 and 9-3 of the electromagnets which are physically adjacent to each other are connected to a transistor T1. Similarly, the coils 9-5 and 9-7 are connected to a transistor T2; the coils 9-9 and 9-11 are connected to a transistor T3; the coils 9-13 and 9-15 are connected to a transistor T4; the coils 9-17 and 9-19 are connected to a transistor T5; and the coils 9-21 and 9-23 are connected to a transistor T6.

The two wire-dot print heads were used to print 100 characters arbitrarily selected. The average power consumption was as follows:

Prior-art wire-dot print head: 212 watts

Wire-dot print head of the present embodiment: 201 watts

It will be seen that the power consumption of the wire-dot print head of the present embodiment is superior by about 5% to the power consumption of the prior-art wire-dot print head.

It has also been confirmed that the wire-dot print head of the present embodiment has a substantial advantage when the print pattern requires that several print wires adjacent to each other are driven simultaneously.

Now a second embodiment will be described.

Figure 2:
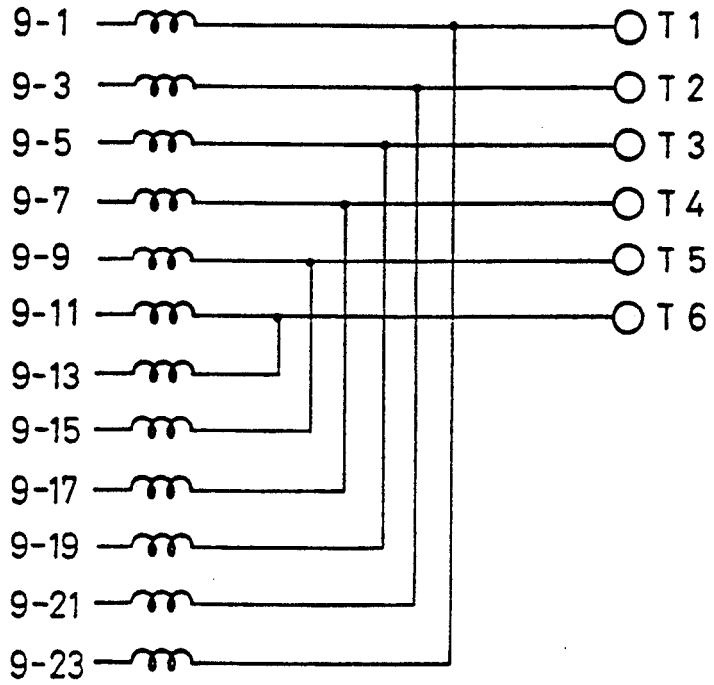
FIG. 2 is a wiring diagram showing a second embodiment of the present invention.

FIG. 2 is a wiring diagram showing a second embodiment of the wire-dot print head according to the present invention. In FIG. 2, the coils are shown to be arranged along a line, but it should be understood that they are actually arranged along a circumference of a rear yoke. In this second embodiment, the coils 9-1 and 9-23 are connected to a transistor T1; the coils 9-3 and 9-21 are connected to a transistor T2; the coils 9-5 and 9-19 are connected to a transistor T3; the coils 9-7 and 9-17 are connected to a transistor T4; the coils 9-9 and 9-15 are connected to a transistor T5; the coils 9-11 and 9-13 are connected to a transistor T6.

In this case, the coils 9-11 and 9-13 of the electromagnets positioned physically adjacent to each other are commonly controlled by the transistor T6. But the coils 9-1 to 9-9 and 9-15 to 9-23 controlled by the transistors T1 to T-5 are not physically adjacent to each other. Accordingly, a result similar to that of the first embodiment is obtained.

Figure 3:
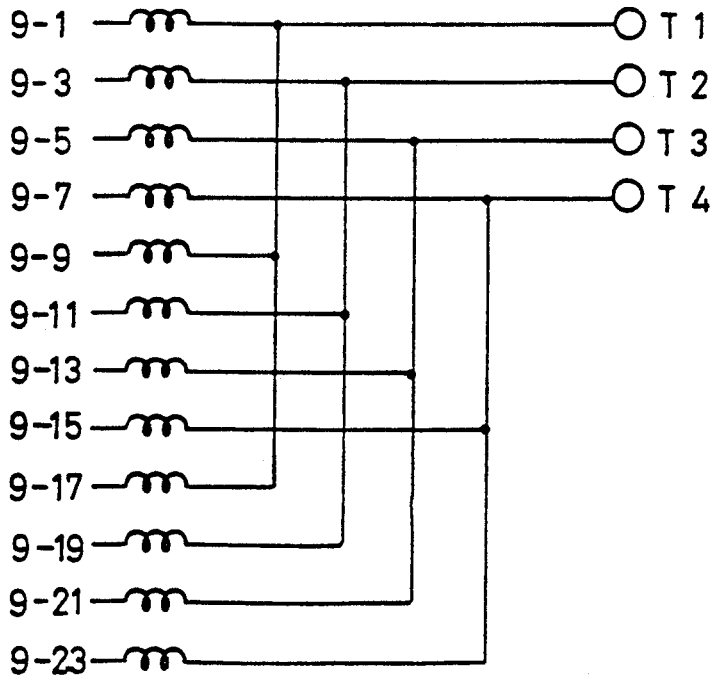
FIG. 3 is a wiring diagram showing a third embodiment of the present invention.

FIG. 3 is a wiring diagram showing a third embodiment of the wire-dot print head according to the invention. In FIG. 3, the coils are also shown to be arranged along a line, but it should be understood that they are actually arranged along a circumference of a rear yoke. In this third embodiment, as illustrated, the coils 9-1, 9-9, and 9-17 are connected to a transistor T1, the coils 9-3, 9-11 and 9-19 are connected to a transistor T2, the coils 9-5, 9-13 and 9-21 are connected to a transistor T3, and the coils 9-7, 9-15 and 9-23 are connected to a transistor T4.

In this third embodiment, each block has three electromagnets, and each block is associated with transistors T1 to T4, and the electromagnets in each block are disposed so as not to be physically adjacent to each other. With this configuration, results similar to that of the first embodiment are obtained.

The present invention is not limited to the above-described embodiments, but various modifications can be made with respect to the wiring in view of the total number of electromagnets, and the number of the transistors which are the current conduction control elements.

As has been described according to the invention, at least some of all the electromagnets having coils energized through a common current conduction control elements are disposed so as not to be physically adjacent to each other. As a result, the power consumption due to the magnetic interference between adjacent electromagnets is reduced.

A wire-dot print head with a reduced power consumption can thereby be provided.

Moreover, because of the reduction of the power consumption per print element, generation of heat from the electromagnet can be reduced, and printing can be effected at a high duty ratio.

What is claimed is:

1. A wire-dot print head comprising:

a plurality of print elements arranged in a ring, each comprising:

an armature to which a print wire is secured;

a plate spring having a free end supporting the armature;

an electromagnet having a core on which a coil is wound and which faces the armature;

a permanent magnet for generating a magnetic flux in said core of said electromagnet to attract the armature;

common current conduction control elements, each provided in association with a plurality of said electromagnets, connecting first ends of the coils of the associated electromagnet to a first terminal of a DC power supply and being used to control electric currents through the coils of the associated electromagnets;

individual current conduction control elements provided for the respective electromagnets, each individual current conduction control element connecting a second end of the coil of the associated electromagnet to a second terminal of the power supply to control an electric current through the coil of the associated electromagnet;

a first current path means provided for each electromagnet, permitting an electric current to flow from said first terminal of the power supply through said coil of the electromagnet to said second terminal of the power supply when the associated common current conduction control element and the associated individual current conduction control element are both ON;

a second current path means provided for each electromagnet, permitting an electric current due to an electromotive force induced in said coil to flow through said coil when the associated common current conduction control element is OFF and the associated individual current conduction control element is ON;

a third current path means provided for each electromagnet, permitting an electric current due to an electromotive force induced in said coil to flow from said second terminal of the power supply, through said coil to said first terminal of the power supply when the associated common current conduction control element and the associated individual current conduction control elements are both OFF;

wherein said electromagnets are divided into groups, each group comprises three or more electromagnets which are adjacent to each other, and none of the electromagnets belonging to the same group are connected to the same common current conduction control element.

2. A wire-dot print head according to claim 1, wherein said second current path means comprises a common diode connected across the series connection of the individual current conduction control element and the coil of the electromagnet to permit an electric current due to the electromotive force induced in the coil after the common current conduction control element is turned OFF, to flow through the coil, the individual current conduction control element and the common diode.

3. A wire-dot print head according to claim 2, wherein said third current path means comprises individual diodes provided for respective coils, each of the individual diodes being connected across the series connection of said common current conduction control element and the coil to permit an electric current due to an electromotive force induced in the coil after the common current conduction control element and the individual current conduction control element have been turned OFF, to flow through the second terminal of the power supply, the coil, the individual diode and the first terminal of the power supply.

4. A wire-dot print head according to claim 1, wherein said common current conduction control element and said individual current conduction control elements are ON during a first stage of printing operation which lasts until about the commencement of actual movement of the print wire.

5. A wire-dot print head according to claim 4, wherein said common current conduction control element is OFF and said individual current conduction control element is ON during a second stage of printing operation which lasts until about the impact of the print wire onto the print paper.

6. A wire-dot print head according to claim 1, wherein the first and second terminals of the power supply are a positive and negative terminals, respectively;

the common current conduction control element is a PNP transistor having an emitter connected to the first terminal of the power supply;

the individual current conduction control element is an NPN transistor having an emitter connected to the second terminal of the power supply;

the common diode has its anode connected to the emitters of the NPN transistors for each block, and has its cathode connected to the first ends of the coils for each block; and the individual diodes have their anodes connected to the second ends of the coils, and have their cathodes connected to the first terminal of the power supply.

7. A wire-dot print head comprising:

a substantially disk-shaped rear yoke;

electromagnets each comprising a core mounted on the front surface of said disk-shaped rear yoke and near the center of said disk-shaped rear yoke, and a coil wound on the core;

the electromagnets being arranged in a ring near the center of said disk-shaped rear yoke;

an annular permanent magnet;

a front yoke having an annular part and radial parts;

said annular permanent magnet, and said annular part of said front yoke being stacked with each other, mounted on said front surface of said disk-shaped rear yoke and disposed on the peripheral part of said disk-shaped rear yoke;

a plate spring having a base end clamped between the front yoke and the intermediate yoke and radial parts extending radially inward from said base end;

combinations of an armature and a print wire, each associated with each radial part of the plate spring, the print wire being attached to the armature, and the armature being attached to the associated radial part of the plate spring so that the armature is in the vicinity of the front end of the core of the electromagnet;

said radial parts of said front yoke being disposed between adjacent armatures;

wherein said armature is attracted toward said core when the electromagnet is not energized; and when the electromagnet is energized, the magnetic flux due to the electromagnet cancels the magnetic flux due to said permanent magnet and said armature is released, whereby the print wire mounted to the armature projects for effecting printing;

said wire-dot print head further comprising:

common current conduction control elements, each provided in association with a plurality of said electromagnets, connecting first ends of the coils of the associated electromagnets to a first terminal of a DC power supply and used to control electric currents through the coils of the associated electromagnets;

individual current conduction control elements provided in association with the respective electromagnets, each individual current conduction control element connecting a second end of the coil of the associated electromagnet to a second terminal of the power supply to control an electric current through the coil of the associated electromagnet;

a first current path means provided for each electromagnet, permitting an electric current to flow from said first terminal of the power supply through said coil of the electromagnet to said second terminal of the power supply when the associated common current conduction control element and the associated individual current conduction control element are both ON:

a second current path means provided for each electromagnet, permitting an electric current due to an electromotive force induced in said coil to flow through said coil when the associated common current conduction control element is OFF and the associated individual current conduction control element is ON;

a third current path means provided for each electromagnet, permitting an electric current due to an electromotive force induced in said coil to flow from said second terminal of the power supply, through said coil to said first terminal of the power supply when the associated common current conduction control element and the associated individual current conduction control element are both OFF;

wherein said electromagnets are divided into groups, each group comprises three or more electromagnets which are ajacent to each other, and none of the electromagnets belonging to the same group are connected to the same common current conduction control element.

8. A wire-dot print head according to claim 7, wherein said second current path means comprises a common diode connected across the series connection of the individual current conduction control element and the coil of the electromagnet to permit an electric current due to the electromotive force induced in the coil after the common current conduction control element is turned OFF to flow through the coil, the individual current conduction control element and the common diode.

9. A wire-dot print head according to claim 8, wherein said third current path means comprises individual diodes provided for respective coils, each of the individual diodes being connected across the series connection of said common current conduction control element and the coil to permit an electric current due to an electromotive force induced in the coil after the common current conduction control element and the individual current conduction control element have been turned OFF, to flow through the second terminal of the power supply, the coil, the individual diode and the first terminal of the power supply.

10. A wire-dot print head according to claim 7, wherein said common current conduction control element and said individual current conduction control element is ON during a first stage of printing operation which lasts until about the commencement of actual movement of the print wire.

11. A wire-dot print head according to claim 10, wherein said common current conduction control element is OFF and said individual current conduction control element is ON during a second stage of printing operation which lasts until about the impact of the print wire onto the print paper.

12. A wire-dot print head according to claim 7, wherein the first and second terminals of a power supply are positive and negative terminals, respectively;

the common current conduction control element is a PNP transistor having an emitter connected to the first terminal of the power supply;

the individual current conduction control element is an NPN transistor having an emitter connected to the second terminal of the power supply;

the common diode has its anode connected to the emitters of the NPN transistors for each block, and has its cathode connected to the first ends of the coils for each block; and the individual diodes have their anodes connected to the second ends of the coils and have their cathodes connected to the first terminal of the power supply.

* * * * *